United States Patent [19]

Karpp

[11] Patent Number: 4,807,323

[45] Date of Patent: Feb. 28, 1989

[54] FLOOR MOP

[76] Inventor: Heinrich Karpp, Fahrenberg 19A, 4300 Essen 15, Fed. Rep. of Germany

[21] Appl. No.: 163,811

[22] PCT Filed: Jun. 25, 1987

[86] PCT No.: PCT/EP87/00343

§ 371 Date: Feb. 18, 1988

§ 102(e) Date: Feb. 18, 1988

[87] PCT Pub. No.: WO88/00019

PCT Pub. Date: Jan. 14, 1988

[30] Foreign Application Priority Data

Jul. 3, 1986 [DE] Fed. Rep. of Germany ..... 3622291
Nov. 8, 1986 [DE] Fed. Rep. of Germany ..... 3638178

[51] Int. Cl.[4] ..... A47L 13/258

[52] U.S. Cl. ..... 15/147 A; 15/228; 15/229.8

[58] Field of Search ..... 15/228, 229.1–229.9, 15/119 R, 119 A, 120 R, 120 A, 116.1, 116.2, 147 R, 147 A, 147 B, 147 C, 149

[56] References Cited

U.S. PATENT DOCUMENTS 1,526,455 2/1925 Beaudet ..... 15/149
2,975,451 3/1961 McPherson ..... 15/147 A

FOREIGN PATENT DOCUMENTS 2282252 3/1976 France .

*Primary Examiner*—Peter Feldman
*Attorney, Agent, or Firm*—Herbert Dubno

[57] ABSTRACT

The invention relates to a floor mop, which has a support for holding an attachment or the like provided on its underside with a plurality of fringes or the like, or with a raised-pile washing attachment or the like, consisting of two arms and a central piece, whereby the two arms of the support are pivotably linked to the central piece at their mutually facing frontal sides and the central piece is equipped with a handle holder mounted in the middle thereof. In order to produce a floor mop of the mentioned kind, which is not only easily produced and assembled, but also insures rapid, clean and safe handling with regard to the application and removal of the fringe-coated attachment, the invention proposes that the central piece (7) be provided with a bottom plate (11) pivotably connected to both arms (5, 6), to which a support plate (11) is fastened with a disk spring (14) rotatably arranged thereon, on which spring disk a thereto connected clamping disk (18) is located, the handle holder (28) being secured thereto, whereby on the upper sides of the two arms (5, 6) tension springs (25) provided for tensioning the same are guided in a groove (17) or the like of the spring disk (14).

25 Claims, 7 Drawing Sheets

FLOOR MOP

Figure 1:
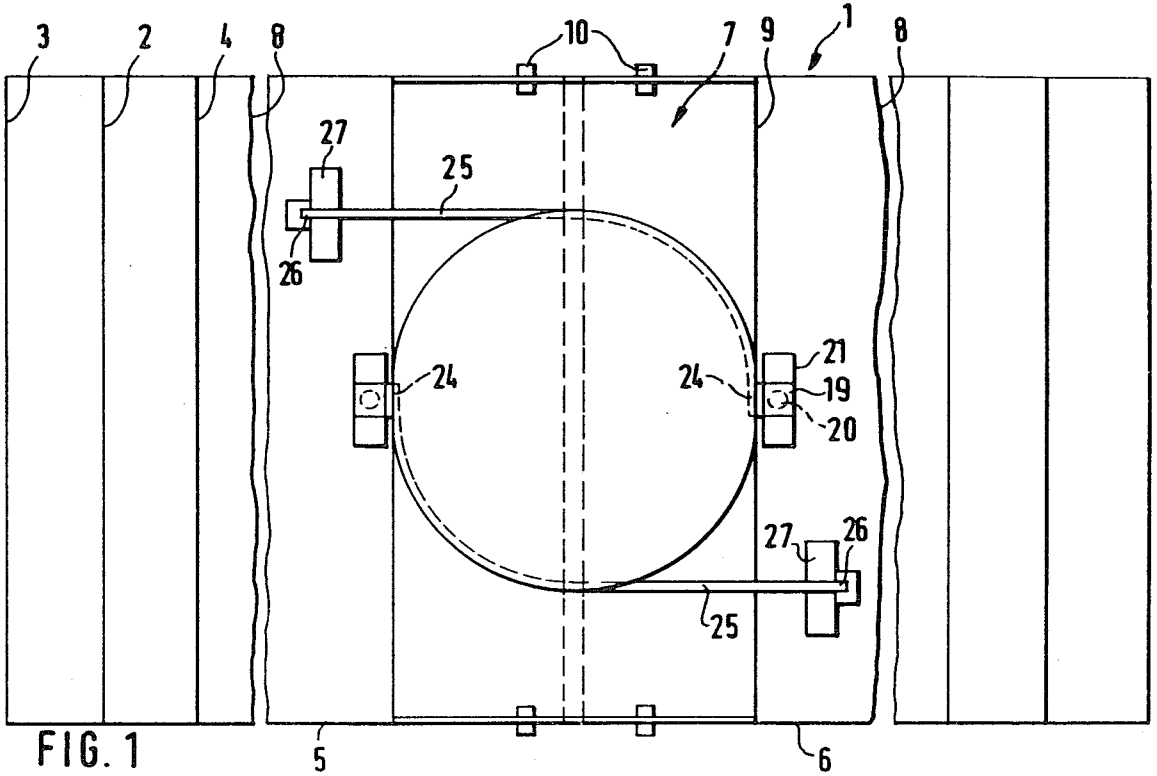

The invention relates to a floor mop having a support for holding an attachment provided on its underside with a plurality of fringes or the like, or with a raised-pile washing attachment or the like, which consists of two arms and a central piece, whereby the arms of the support are pivotably connected with the central piece at their mutually facing ends and the central piece is equipped with a handle support arranged in the middle thereof.

In a known floor mop of this kind, in the two arms, locking devices are provided, which makes possible a locking in position between the central piece and the pivotable arms. By means of outwardly protruding pegs, it is possible to unlock the locking device, so that the arms can be swung away downwardly with respect to the central piece and the attachment provided with fringes or the like can be detached from the arms. The refastening of the attachment and the swinging in place of the arms of the support follows the reverse order. The fastening of the attachment to the ends of the arms takes place for instance by means of Velcro-type fastening tapes, which pass through hooks or the like arranged at the ends of the arms. A disadvantage of this known floor mop consists in the fact that its arms have to be shaped like a housing, in order to accommodate the locking device, which results not only in comparatively complicated manufacturing, but also in cumbersome mounting. A further disadvantage of this known mop consists in the fact that, in order to clamp it together or to clamp it apart, both hands have to be used, whereby on the one hand the handle becomes an impediment and, on the other hand, there is the danger of contamination with dirt.

Departing from this state of the art, it is the object of this invention to create a floor mop wherein the aforementioned disadvantages are avoided and which is not only easy to manufacture and to assemble, but also provides in addition for a quick, clean and safe handling with respect to the fastening and the detaching of the attachment covered with fringes or the like.

In accordance with the invention, this problem is solved by the fact that the central piece has a bottom plate pivotally linked with the two arms, to which a support plate is attached, a spring disk being rotatably arranged thereon, on which a clamping disk connected thereto is located, the handle holder being secured to this clamping disk, whereby tension springs provided on the upper side of both arms are inserted in grooves or the like on the spring disk, in order to tension the arms. Due to this configuration, it is possible by simply turning the handle which serves for manipulation, and therewith by turning the connected tension springs and the thereby linked spring disks by approximately 90°, to cause the locking of the two arms in their working horizontal position, respectively the unlocking, so that the arms spring away downwardly from the bottom plate, whereby a certain spreading position of the two arms is insured, due to the effect of the springs. The downhanging attachment can be cleaned in a press, after which, by raising the slightly spread apart arms and by putting pressure on the handle, the arms will swing away from each other back into their horizontal position and by turning back the handle by 90 degrees they will be locked again in their horizontal working position. The cleaning of the attachment is usually done in a pail of water, whereafter it is pressed dry in a mop press. Due to this configuration, it is possible to cause the tensioning, as well as the unlocking of the two arms by simply turning the handle by 90 degrees in one or the other direction of rotation. The margins of the two arms and of the bottom plate have upturned positions on their longitudinal sides, which are traversed by pivot pins. Thus, both components have U-shaped cross sections, so that an extra flat configuration results, since the central piece and the remaining required components can be arranged within the height of the upwardly bent portion. Besides, the bottom plate prevents an upward swinging of the arms of the support, since the upper sides of the arms rest flatly on the underside of the bottom plate.

The support plate has at least one guide track, to which a guide pin of the spring disk located thereabove is assigned. The guide track consists of a groove, wherein into the guide pin of the spring disk extends. The guide track has the shape of a quadrant. This way, the guide track makes possible a rotation of the spring disk, as well as of the tensioning spring by 90 degrees, whereby the frontal edges of the guide groove have each a stopper for the guide pin and this way secured the arresting of rotation.

The spring disk is rotatably supported on the support plate by means of a thread bolt, which is threaded by several turns into the support plate, so that not only the possibility of a perfect fastening is created, but also the possibility of a 90 degrees rotation movement.

The spring disk is circularly shaped and has at its outer frontal edge a groove or the like which serves to receive and guide the tension springs.

The tensioning disk is also circularly shaped and has two oppositely located protruding shoulders, which carry downwardly extending arresting pins. The arresting pins are generally spherically shaped.

On the upper side of the arms, on each side of the central piece, there is a receiving element for the arresting means, which is assigned to the arresting pins of the tensioning disk, so that these come to stop in the tensioning disk and the spring disk when they are in their tensioned position, insuring this way the horizontal working position of the two arms. The receiving elements for the arresting means are arranged transversely with respect to the longitudinal direction of the arms, approximately in their middle portion. As a result of the rotation by 90 degrees of the tensioning disk, the arresting pins are pivoted from the release position, through turning by 90 degrees, into the receiving element, with concurrent tensioning of the tension springs. The receiving elements for the arresting pins in themselves have an approximately U-shaped cross section and have, approximately in their median areas, convexities which serve as guide tracks for the arresting pins. In the bulges of the receiving element, holes are provided in the median section, which fit the ball shape of the arresting pin, so that in the tensioned position they lodge in these holes.

In the grooves or the like of the spring disk one of the ends of each two tension springs are fastened, offset by 180 degress with respect to each other, their other ends being respectively attached to a support which is located on the upper sides of the arms. The arrangement of the tension springs is such that in their tensioning positions they surround the spring disk by a circumference of approximately 90 degrees and then run approximately in a straight line with respect to the supports. In the release position of the clamping disk, as well as of the spring disk, the tension springs limit the downward swinging away of the two arms of the support, so that a certain desired opening angle of the two arms is always insured.

In accordance with a further solution offered by the invention, the spring and clamping disks can be combined in a single component. In this case, the spring and clamping disk consists of an essentially rectangular locking bar, which has grooves or the like on its outer frontal edge, whereby two parallelly running tensioning springs are assigned thereto, their respective ends being fastened to upper sides of the arms and their central segments being guided in the grooves or the like of the locking bar. This embodiment is particularly simple, since the number of components of the central piece is further reduced. It is operated so that through the rotation of the handle by 90 degrees and through the spreading of the two tension springs the tensioning is achieved, so that the arms of the support are secured in their horizontal working position, while by continuing to rotate or rotating back by 90 degrees the spreading of the tension springs is cancelled, since the central segments of the springs are resting now against the longitudinal sides of the locking bar, so that the locking effect is cancelled and the two arms can be swung away downwardly.

In order to further improve the handling of the floor mop of the afore-mentioned kind according to a further feature of the invention, it is proposed that the spring disk and/or the clamping disk have at least one notch or groove or the like in the area of their outer circumference, respectively circumferences, and that the free end of one of the arms of a two-arm lever be assigned to this notch, groove or the like, the two-arm lever being swingably supported on one arm of the support, and that its other arm be under the tensioning effect of a spring, in such a manner that the free end of the one arm of the two-arm lever is held pressed against the outer circumference, respectively outer circumferences of the spring disk and/or clamping disk. This way, a secure fastening of the spring- and clamping disk in the working position of the mop floor is insured, since the free end of the one arm of the two-arm lever lodges into the notch, groove or the like of the spring disk and/or the clamping disk, fitting its shape. Thereby, it is not possible to change the working position of the floor mop, i.e. horizontal position of the arms while the mop is in use. For this purpose, it is rather necessary to apply a force to the other arm of the two-arm lever which is under the effect of a spring so that it is subjected to a displacement against the action of the spring in such a manner that the free arm of the two-arm lever swings out from the notch, groove or the like of the spring- and/or clamping disk and releases these. Now, by turning the handle holder, the working position of the floor mop can be changed, so that the two arms thereof perform a downwardly swinging motion under the effect of the tension springs.

According to a further feature of the invention, the upturned portions on the edges of the longitudinal sides of the two arms have recesses in their end areas. so that it is possible in the downwardly swung position of the arms and the thereby downhanging attachment to put the latter in a press, so that it is effectively wrung out over its entire length and thereby cleansed.

Advantageously, the edges of the two arms are provided on their transverse sides with bentup portions, which have a minimal height and run somewhat rectangularly. This way a rolling effect results, during the swinging of the arms on the inside of the attachment, which greatly facilitates the tensioning of the same in order to set the floor mop in its operational position.

According to a further proposal of the invention, in the bottom plate of the mop, in the area of motion of at least one arresting bolt, a polyhedral hole is provided, wherein the correspondingly polyhedrally shaped end of an arresting bolt can be inserted, wherefrom a neck passes into a polyhedral head of the bolt, preferably off-center.

At least the neck of the bolt is made of a partially elastic material. The head of the bolt can be provided in addition with one or several cuts running in its direction of insertion, in order to increse its elasticity. By providing the polyhedral bolt in the swinging area of at least one arresting pin, a safeguarding of the clamping disk and of the part of the floor mop rotating therewith against unintended reverse turning is achived. After the attachment has been cleaned, both arms of the floor mop hang downwardly, whereby under the action of the tension springs, they form a small angle between them. By turning the floor-mop handle, the springs are tensioned, whereby the arresting bolts of the clamping disk, after a certain angle range, press the inserted polyhedral bolt to the side as a result of its elasticity, reaching behind it, so that the two arms are in a wider spread position with respect to each other. From this position of the arms, they can be brought very easily to their horizontal position, and thus to their operational position during the use of the floor mop, since the floor mop is prevented from being turned and thereby from returning the arms into their spring-released position. Due to this configuration, the use of the floor mop is considerably facilitated, namely with respect to the tensioning of the two arms and their downwardly swung position in the horizontal working position.

The neck of the bolt abuts eccentrically in its head, so that by turning the bolt it is possible to set various distances of the head to the arresting bolt, by simply resetting the same.

Figure 2:
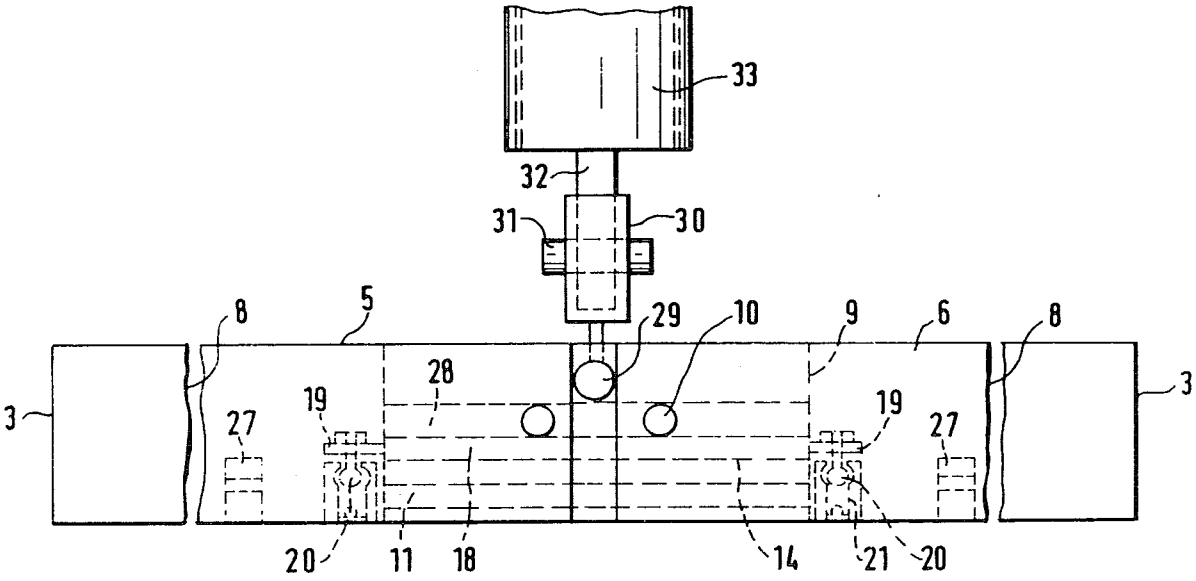
Figure 4:
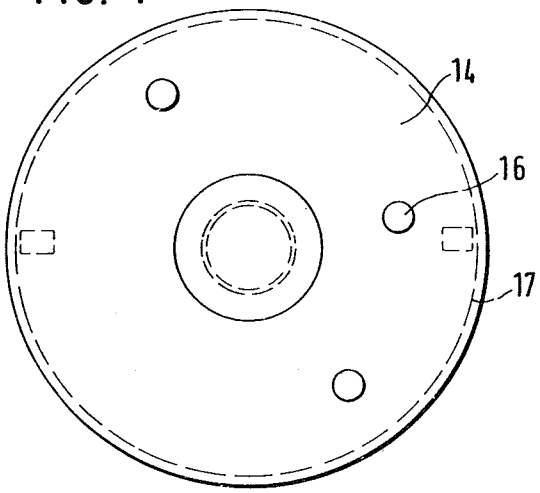
Figure 3:
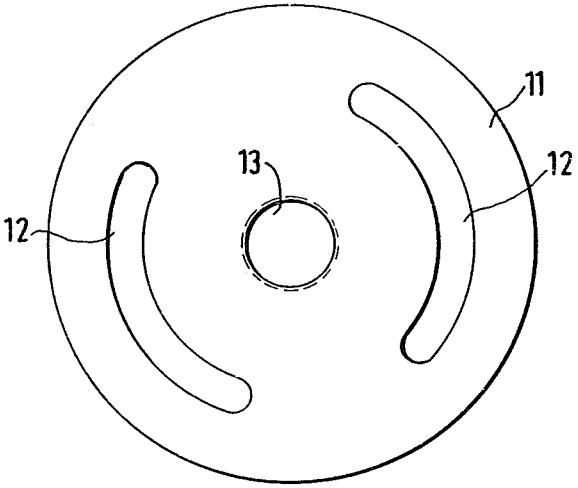
Figure 5:
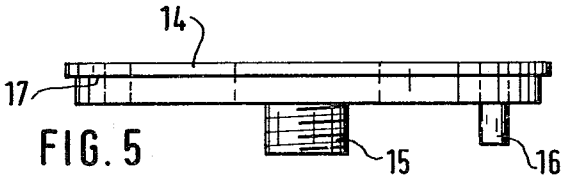
Figure 8:
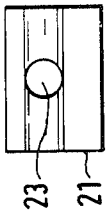
Figure 7:
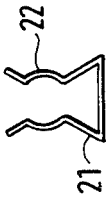
Figure 10:
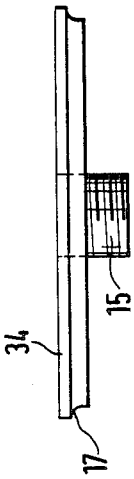
Figure 6:
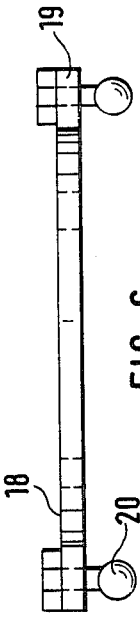
Figure 9:
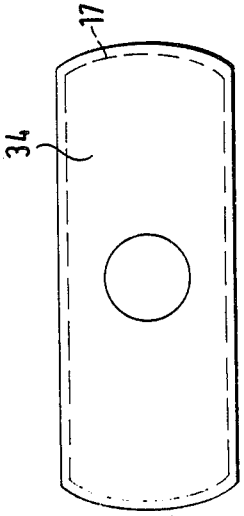
Figure 11:
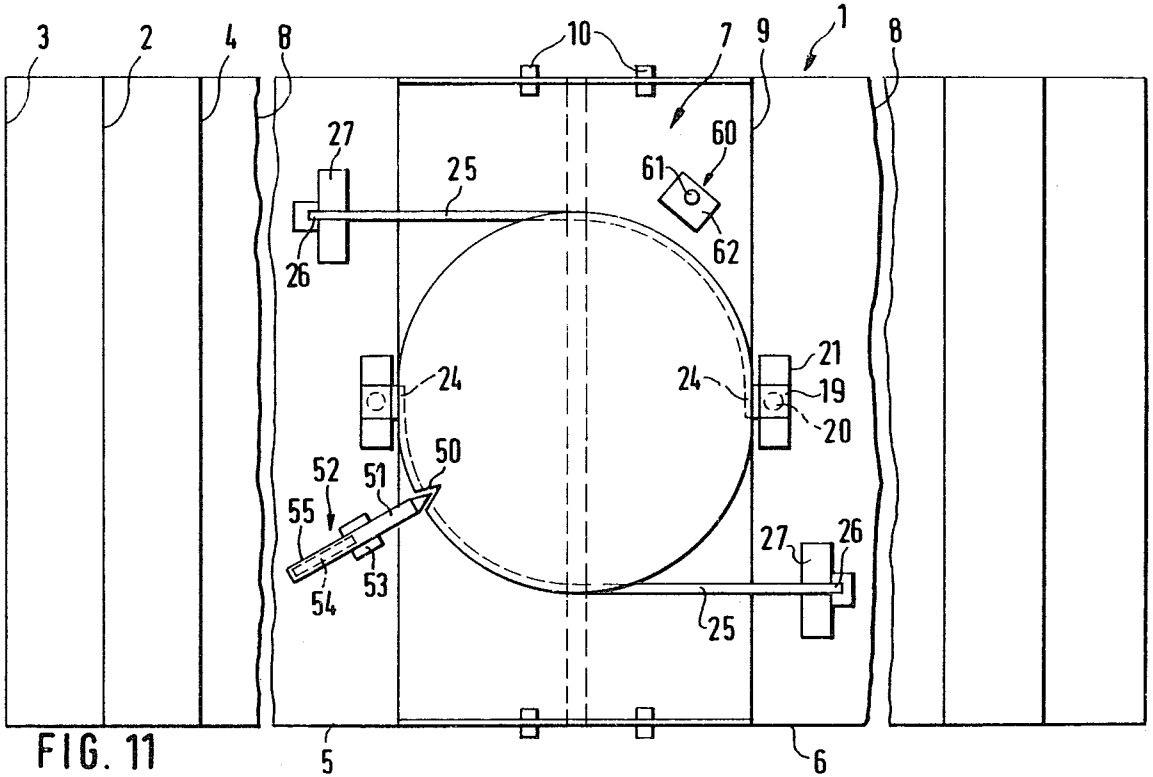
Figure 12:
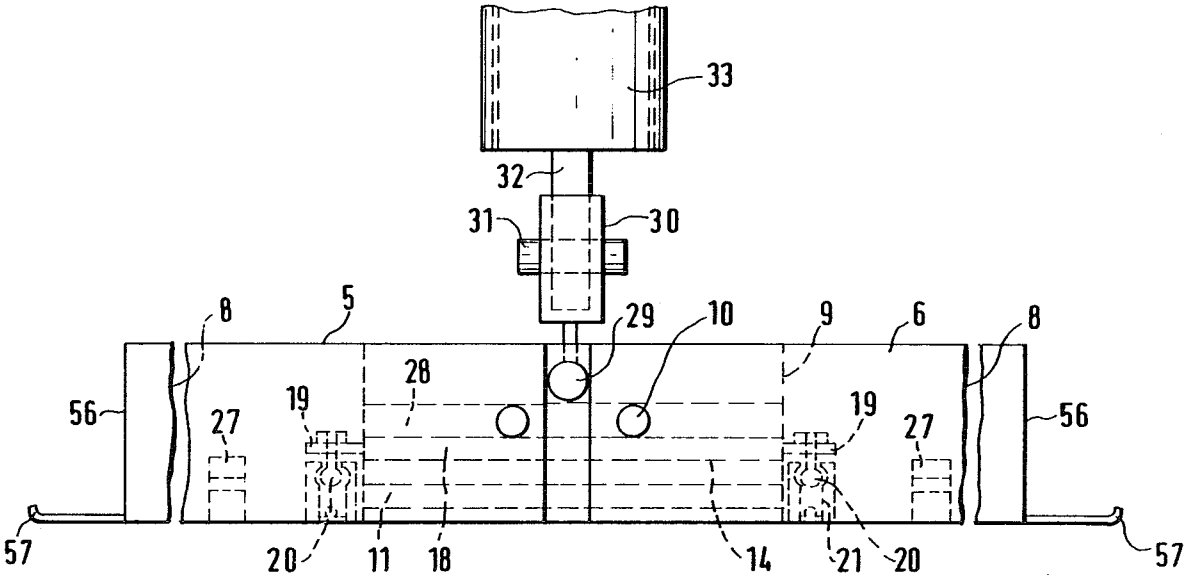
Figure 13:
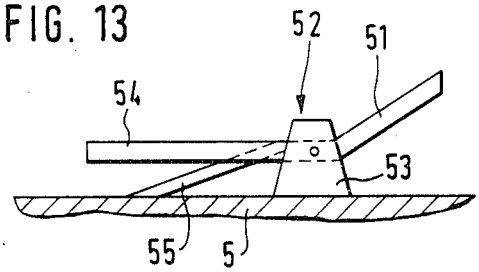

Embodiment examples of the invention are closer described with the aid of the drawing, which shows:

FIG. 1 a top view of a first embodiment of a floor mop,

FIG. 2 a side view of FIG. 1,

FIG. 3 a top view of the support plate,

FIG. 4 a top view of the spring disk,

FIG. 5 a side view of FIG. 4,

FIG. 6 a frontal view of the clamping disk,

FIG. 7 a frontal view of the receiving element for the arresting pin,

FIG. 8 a side view of FIG. 7,

FIG. 9 a top view of the one-piece spring- and clamping disk,

FIG. 10 a side view of FIG. 9,

FIG. 11 a top view of a second embodiment of the floor mop,

FIG. 12 a side view of FIG. 11,

FIG. 13 a frontal view of an arresting device, and

Figure 14:
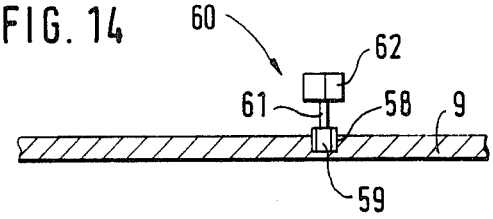

FIG. 14 a partially sectioned frontal view of the bottom plate with inserted polyhedral bolts.

The floor mop has a support 1 for holding at its bottom side of an attachment 2 with a plurality of fringes or the like, which is positioned in the usual way around the terminal edges 3 of the support and detachably fastened to the upper sides of the two arms 5, 6 by means of a velcro-type locking device 4.

The support 1 consists of the two arms 5, 6, as well as of the central piece 7.

In FIGS. 1 and 2, the division lines are marked with 8, since the support 1, for the sake of a better overall view, could not be represented in its entire length. Besides, in FIG. 2 the attachment 2 is ommitted, so that the support 1 can be shown more clearly.

The central piece 7 has a bottom plate 9, which rests on the upper sides of the two arms 5, 6 of the support 1, and which has a U-shaped cross section just like these, whereby the arms 5, 6, as well as the bottom plate 9 have upturned portions on their longitudinal edges. The upturned portions are traversed by pivot pins 10, which swingably connect to each other the two arms 5, 6 on the one hand and the bottom plate 9 on the other.

On the bottom plate 9 a support plate 11 is mounted, which can have circular, but also rectangular cross sections, as can be seen from FIG. 3. The fastening of the support plate 11 to the bottom plate 9 can be done through threading or riveting or the like. The support plate 11 is provided in the illustrated case with two guide tracks 12, each consisting of a groove and shaped like a quadrant, i.e. they extend over an angle of 90 degrees. In its central area, the support plate has a threaded bore 13.

The spring disk 14 is rotatably mounted on the suport plate 11, as can be seen from its configuration shown in FIGS. 4 and 5. In the central area of the spring disk, there is a downwardly extending thread bolt 15, with which the spring disk is screwed by a few convolutions into the threaded bore 13 of the support plate, so that on the one hand a fastening takes place, and on the other hand there is a possibility of rotating the spring disk 14 with respsect to the support plate 11. This rotatability is limited to an angle of approximately 90 degrees. For this purpose, one or one each guide pin 16 extends into one or one each guide track 12 of the support plate 11. The frontal edges of the guide track 12 limit then the rotation of the spring disk 14.

The spring disk 14 is circularly shaped and has a groove 17 on its outer frontal edge, whose function will be described hereinafter.

The clamping disk 18 is mounted to the spring disk 14, whereby the two are connected to each other through screwing, riveting or the like. The clamping disk 18 (FIG. 6) is circularly shaped, just like the spring disk 14. In two circumferentially opposite areas, the clamping disk 18 is provided wth protruding shoulders 19, carrying the downwardly extending arresting pins 20. These are essentially spherically shaped.

On the upper side of the arms 5, 6, on each of the two sides of the central piece, there is a receiving element 21 for the arresting means, assigned to the arresting pin 20 of the clamping disk 18. The receiving elements 21 run transversely with respect to the longitudinal direction of the arms 5, 6 and are arranged approximately in their median portion. The receiving elements 21 for the arresting means have a cross section coming close to a U-shape and present the convexities 22 approximately in their median areas. In the median portion of these bulges 22 of the receiving elements 21 for the arresting means, bores 23 are provided.

In the recesses 17 of the spring disk 14, the end 24 of two tension springs 25 are attached, whose other ends 26 are each fastened to a support 27, located on the upper sides of the arms 5, 6. For this purpose, the ends 26 of the tension springs 25 traverse the supports 27 and are fastened to their backsides by means of split pins or the like. The arrangement of the tension springs 25, consisting of thread-like wire circumvolutions, is such that in their tensioned positions, as seen in FIGS. 1 and 2, they surround the spring disk 14 circumferentially for at least 90° and then run approximately in a straight line with respect to the supports 27.

As can be seen from FIG. 2, the handle holder 28 is fastened on the clamping disk 18, the handle holder having a hinge 29, whose pivoting part 30 is pivotably connected to the extension 32 of the handle bushing 33, via the swivel axle 31, so that a pivoting of the handle bushing 33 by 180° around the hinge 29, respectively the swivel axle 31, can take place in two planes running perpendicularly to each other. In the horizontal position of the two arms 5, 6 of the support 1, the pivoting axis of the hinge 29 of the handle support 28 runs in the longitudinal direction of the support 1. This represents the working position of the floor mop, so that the handle can be pivoted in the required direction, for working with the floor mop.

The modus operandi of the device according to the invention can be described as follows:

In the position as shown in FIGS. 1 and 2, the support 1 of the floor mop is in its working position, wherein the two arms 5, 6 of the support 1 are tensioned mutually, as well as with the central piece 7 in a horizontal plane. Thereby, the arresting pins 20 of the clamping disk 18 are lodged in the receiving elements 21 and arrested through their bores 23. The tension springs 25 surround each the spring disk 14 along a surrounding area of approximately 90 degrees and are thereby tensioned.

By turning the handle holder 28 by 90 degrees to the left from the position shown in FIGS. 1 and 2, the arresting pins 20 are dislodged from the receiving elements 21 with simultaneous relaxation of the tension springs 25, so that the two arms 5, 6 of the support 1 can be swung downwardly due to their own weight, as well as to the weight of the attachment 2, fastened thereto. The length of the tension springs 25 in cooperation with the arrangement of the arresting supports 27 limit the downwardly swinging motion, so that the arms can not flip downwardly by 180 degrees and this way come to lie parallely to each other and so that a desired spreading angle between the free ends of the two arms 5, 6 is preserved. At this point, the downwardly hanging attachment 2 is immersed into a pail of water, rinsed, and after that, wrung out by means of a press.

After that, the support is positioned on the floor, whereby its two arms 5, 6, based on the existent spreading angle and through the application of pressure on the handle holder 28, and thereby on the central piece, are spread apart with a simultaneous tensioning of the attachment 2. By turning the handle holder to the right by 90 degrees, the tensioned position shown in FIGS. 1 and 2 results again.

The entire operation of the floor mop is performed by holding the mop handle, not shown here, whereby a rotation of the same by 90 degrees in either one or the other direction of rotation is carried out, or pressure is applied in order to cause the spreading apart of the two arms 5, 6.

As a result of the elasticity of the used tension springs 25, it is possible to combine the spring disk 14 and the clamping disk 18 to a rectangular locking bar 34. The locking bar 34 presents grooves 17 on its outer frontal edges, as well as the centrally positioned threaded bolt 15 for its fastening to the bottom plate 11. In the use of the locking bar 34, two mutually parallel tension springs, extending in the longitudinal direction of the support 1, can be utilized. Their ends are each fastened to supports. The median segments of the tension springs run in the grooves 17 of the locking bar 34 and rest against the longitudinal sides of the support, when the latter is in released position, and in the locked position of the arms 5, 6 of the support 1, they rest against their transverse sides, so that these are spread apart.

The handling of the floor mop is the same as described above, however, it is not necessary to provide arresting means for the limitation of the rotation, since the handle holder can be continuously rotated in one direction by 90 degrees.

In the embodiments according to FIGS. 11–14, the same reference numerals are used as the ones used for similar components in the embodiment according to FIGS. 1–10.

As can be seen from FIG. 11 and FIG. 13, the clamping disk 18 can be provided along its outer circumferential surface with a notch 50. The free end of the one arm 51 of a two-arm lever 52 is assigned to this notch, the two-arm lever being pivotably supported on the arm 5 by means of the bearing block 53. The other arm 54 is under the action of a spring 55 in such a manner that the free end of the one arm 51 is kept pressed against the outer circumferential surface of the clamping disk 18. When faced by the notch 50, the free end of the one arm 51 gets lodged in the notch, so that the clamping disk 18 is secured against turning. This arresting effect can only then be cancelled, when a force is applied on the other lever arm 54, by pressing the same against the action of the spring 55, so that the one arm 51 swings out from the notch 50.

As can be seen from FIG. 12, at the upturned portions of the longitudinal edges of the two arms 5, 6, in their terminal areas, recesses 56 are provided, which, in the relaxed state of the arms 5, 6 and the downhanging of the thereto affixed attachment, make possible an introduction of the attachment in a press, so that it can be wrung out over its entire length.

The edges of the two arms 5, 6 are provided with upbendings 57 on their tranverse sides, these upbendings being of minimal height and preferably running somewhat rectangularly. These upbendings 57 create a rolling effect during the tensioning of the two arms 5, 6 upon the inside of the attachment, so that this operation is considerably facilitated.

As can be seen from FIGS. 11 and FIG. 14, in the bottom plate 9, in the motion range of an arresting pin 20, a polyhedral bore 58 is provided. In the polyhedral bore 58, a correspondingly shaped polyhedral leg 59 of a bolt 60 is inserted. From the leg, a neck 59 makes the transition to the polyhedral head 62 of the bolt 60. The neck ends eccentrically with the head 62, so that correspondingly various distances between the sides of the head 62 and the longitudinal axis of the neck 61 result, thereby leading to various spacings from the bolt 20. At least the neck 61 is made of a material with limited elasticity, so that the same can be pressed sidewards by the arresting bolt 20, but after the passage of the arresting bolt 20, it resumes its initial position. The elasticity of the bolt 61 can be increased by making one or several cuts running in its insertion direction.

Due to this configuration, it can be achieved that by rotating the clamping disk 18 by a certain angle, the arresting bolt 20 assigned to the inserted bolt 60, can swing over it by pressing the same sidewards. Due to this motion, in the case of simultaneous tensioning of the tension springs 25, a stronger spreading apart of the two arms 5, 6 takes place, without the possibility that the floor mop can turn under the action of the tension springs 25 and revert to its relaxed initial position. Due to the increased spreading angle, an easy tensioning by pressing the arms against the floor and a subsequent continuation of the rotation of the clamping disk in the arresting position of the arresting bolts 20 is now possible.

I claim:

1. A floor mop having a support for holding an attachment provided on its underside with a plurality of fringes or the like, or with a raised-pile washing attachment, consisting of two arms as well as of a central piece, whereby the arms of the support are pivotably connected with the central piece at their mutually facing ends and the central piece is equipped with a handle arranged in the middle thereof, characterized in that the central piece (7) has a bottom plate (9) pivotably connected with the two arms (5, 6) to which a support plate (11) is attached with a spring disk (14) rotatably arranged thereon, a clamping disk (18) being located on the spring disk and connected thereto, and with the handle holder (28) secured to the clamping disk, whereby on the upper sides of the arms (5, 6), tension springs (25) are provided for their tensioning and guided in a groove (17) of the spring disk (14).

2. A floor mop according to claim 1, characterized in that the edges of the two arms (5, 6) and of the bottom plate (9) have upturned portions on their longitudinal sides, which are traversed by pivot pins (10).

3. A floor mop according to claim 1, characterized in that the support plate (11) is provided with at least one guide track (12) to which a guide pin (16) of the spring disk (14) located thereabove is assigned.

4. A floor mop according to claim 1, characterized in that the guide track (12) is a groove into which extends the guide pin (16) of the spring disk (14).

5. A floor mop according to claim 1, characterized in that the guide track (12) is quadrant-shaped.

6. A floor mop according to claim 1, characterized in that the spring disk (14) is rotatably supported on the support plate (11) by means of a threaded bolt (15) which is screwed into a threaded bore (13) of the support plate (11).

7. A floor mop according to claim 1, characterized in that the disk spring (14) is circularly shaped and has groove (17) on its outer frontal edge.

8. A floor mop according to claim 1, characterized in that the clamping disk (18) is circularly shaped and provided with two protruding shoulders (19) located opposite to each other and which carry downwardly extending arresting pins (20).

9. A floor mop according to claim 1, characterized in that the arresting pins (20) are essentially spherically shaped.

10. A floor mop according to claim 1, characterized in that the upper sides of the arms (5, 6) on both sides of the central piece (7) each have a receiving element (21) assigned to the arresting pin (20) of the clamping disk (18).

11. A floor mop according to claim 1, characterized in that receiving elements (21) are arranged in the median areas of the arms (5, 6), running transversely to their longitudinal direction.

12. A floor mop according to claim 1, characterized in that receiving elements (21) have an approximately U-shaped cross section and have convexities (22) located approximately in their median portions.

13. A floor mop according to claim 1, characterized in that in the median portions of the convexities (22) of the receiving elements (21) bores (23) are provided.

14. A floor mop according to claim 1, characterized in that in the groove (17) of the spring disk (14) the one ends (24) of two tension springs (25) are fastened, offset by 180 degrees with respect to each other, whose other ends (26) are each fastened to a support (27) located on the upper sides of the arms (5, 6).

15. A floor mop according to claim 1, characterized in that the arrangement of the tension springs (25) is such that these, in their tensioned position, surround the disk spring (14) on a circumference of approximately 90 degrees and then run approximately in a straight line with respect to the support (27).

16. A floor mop according to claim 1, characterized in that the spring- and clamping disks are combined in one component.

17. A floor mop according to claim 16, characterized in that the component consists of a basically rectangular locking bar (34), which has the grooves (17) on its outer frontal edge, whereby two mutually parallel tension springs are asisgned to the locking bar, their ends respectively fastened to the upper sides of the two arms (5, 6) and their median segments guided in the groove (17) or the like of the locking bar (34).

18. A floor mop according to claim 1, characterized in that the spring disk (14) and/or the clamping disk (18) are provided in the area of the outer circumferential surface, respectively surfaces with at least one notch or groove (50), the free end of one of the arms (51) of a two-arm lever (52) being assigned to notch (50) groove or the like, said two-arm lever being pivotably supported on one arm (5, 6) and whose other arm (54) is under the action of a spring (55), so that the free end of the one arm (51) of the two-arm lever (52) is kept pressed against the outer circumferential surface, respectively surfaces of the spring disk (14) and/or the clamping disk (18).

19. A floor mop according to claim 2, characterized in that recesses (56) are provided at the upturned portions on the edges of the longitudinal sides of the arms (5, 6), in the terminal areas of the same.

20. A floor mop according to claim 19, characterized in that the edges of the two arms (5, 6) have upbendings (57) on their transverse sides.

21. A floor mop according to claim 20, characterized in that the upbendings (57) are of minimal height and run somewhat rectangularly.

22. A floor mop according to claim 8, characterized in that in the motion range of at least one arresting pin (20) a polyhedral bore (58) is provided, wherein a correspondingly polyhedrally shaped leg (59) is insertable, from which leg a neck (61) makes the transition to a polyhedral head (62) of the bolt.

23. A floor mop according to claim 22, characterized in that the neck (61) of the bolt (60) ends eccentrically with the head (62).

24. A floor mop according to claim 22, characterized in that at least the neck (61) of the bolt (60) is made of a material with limited elasticity.

25. A floor mop according to claim 22, characterized in that the head (62) of the bolt (60) is provided with one or more cuts running in its insertion direction.

* * * * *